United States Patent [19]

Dahlgren

[11] Patent Number: 4,515,079

[45] Date of Patent: May 7, 1985

[54] PLANETARY SYNCHRONIZING DEVICE

[76] Inventor: Harold P. Dahlgren, 11 Turtle Creek Bend, Dallas, Tex. 75204

[21] Appl. No.: 473,852

[22] Filed: Mar. 9, 1983

[51] Int. Cl.[3] ..... B41F 21/08; B41L 21/10

[52] U.S. Cl. ..... 101/183; 101/232

[58] Field of Search ..... 101/174, 183, 184, 177, 101/185, 232, 212, 216, 219, 228, 217, 229; 271/204, 205, 207, 202, 198, 270, 7

[56] References Cited

U.S. PATENT DOCUMENTS

| | | | |
|---|---|---|---|
| 992,172 | 5/1911 | Custer | 271/7 |
| 2,164,363 | 7/1939 | Waters | 101/212 |
| 2,852,252 | 9/1958 | Sperry | 101/118 |
| 3,125,950 | 3/1964 | Ayers | 101/212 |
| 3,280,737 | 10/1966 | Huck | 101/181 |
| 3,664,261 | 5/1972 | Dahlgren | 101/177 |
| 4,238,999 | 12/1980 | Giani et al. | 101/118 |

*Primary Examiner*—J. Reed Fisher

*Attorney, Agent, or Firm*—Gerald G. Crutsinger; John F. Booth; Monty L. Ross

[57] ABSTRACT

A planetary synchronizing system in which the length of an endless elastic conveyor is adjusted to maintain the length of the conveyor a multiple of the circumference of a drive wheel which can be driven at a variable speed, when the diameter of the drive wheel changes.

3 Claims, 9 Drawing Figures

PLANETARY SYNCHRONIZING DEVICE

BACKGROUND OF INVENTION

The invention is a planetary synchronizing system for use in combination with conveyor systems of the type disclosed in Dahlgren U.S. Pat. No. 3,664,261, entitled "STRAIGHT FEED PRESS" and Dahlgren U.S. Pat. No. 3,847,079, entitled "METHOD OF PRINTING SHEETS". The disclosure of each of the aforementioned patents is incorporated herein by reference in its entirety for all purposes.

The aforementioned patents disclosed a sheet-fed printing press which incorporated a straight through and continuous sheet transfer principle, similar to the feeding style of a web-fed printing press, whereby sheets were grasped by gripper bars carried by flexible steel tapes or bands which extended around drive wheels for moving the sheets through a plurality of printing towers.

In printing it is critical that registration of the sheet to each printing cylinder be precisely maintained so that dots on each sheet precisely correspond to a corresponding dot on the other sheets. In single color printing, it is also critical that registration be maintained because sheets are often passed through a printing press more than one time to apply additional colors.

In the conveyor system described in the aforementioned patents, flexible steel tapes were driven by circular wheels mounted adjacent opposite ends of the printing press, with the band having indexing pins mounted therein. This created two major problems which tended to hamper marketability of the system.

First, the expansion of various materials are dependent upon the temperature, although for design purposes constant mean values are usually employed for design purposes. If lengths, areas, and volumes are at a standard temperature, the approximate change in dimensions of the material will be considered to be a function of the change in temperature. At best, such design criteria provides only approximate dimensions and resultant inaccuracy in speed and location of parts. Even though all components of the printing press may be constructed of materials having an identical co-efficient of thermal expansion, the dimensions of various components of the system may change non-uniformly which results in further variation of the speed and location of various parts of the system which is detrimental to registration of the press.

Second, even if thermal expansion is ignored, it is virtually impossible to construct and drive through circular members to maintain absolute registration. The Greek letter $\pi$ pronounced "pi", is the ratio of the circumference of any circle to its diameter and stands for the number by which the diameter of a circle must be multiplied to obtain the circumference. Thus, the circumference of a circle is equal to $\pi$ times the diameter of the circle.

The number $\pi$ cannot be exactly expressed as a decimal. The common values used to express $\pi$ include 22 divided by 7; 3.14; 3.1416; and 3.14159. Rounded off to twenty decimal places, $\pi$ is approximately equal to 3.14159265358979323846.

Thus, the technical problem exists of obtaining absolute accuracy in manufacturing circular members and of maintaining near absolute accuracy of components and of placement of parts of a system under varying conditions of temperature, speed, acceleration and other operating conditions.

Various devices have been devised heretofore for adjusting the tension in a web and the distance a web travels between adjacent printing cylinders in an effort to maintain registration in web-feb printing presses. However, such devices are not readily adaptable for sheet-fed printing presses of the type disclosed in the aforementioned patents because the web is generally routed along a serpentine path to compensate for errors in registration between colors.

SUMMARY OF THE INVENTION

The method and apparatus disclosed herein relate to an improved conveyor system and a planetary synchronizing system to provide register between an endless conveyor surface and a printing cylinder.

The method of maintaining endless surfaces on two members, such as a printing cylinder and an endless sheet conveyor driven by a drive wheel associated with the printing cylinder in a precisely synchronized relationship when the drive wheel and conveyor are in rolling relation requires that the ratio of the surface speed of the endless sheet conveyor to the length of the conveyor be maintained equal to or a multiple of the ratio of the surface speed of the drive wheel to the circumference of the drive wheel.

This relationship can be maintained by two methods, even though the dimensions and surface speeds of both the drive wheel and the sheet conveyor may change as a result of thermal expansion under normal operating conditions.

First, the printing cylinder and the sheet conveyor drive wheel may be drivingly connected together through a device which permits adjustment of the surface speed of the printing cylinder relative to the surface speed of the sheet conveyor drive wheel to restore the required speed to distance relationship if the speed or dimensions or both of either the drive wheel or the sheet conveyor changes.

Second, either the circumference of the conveyor drive wheel or the length of the sheet conveyor can be adjusted relative to the other to restore the required speed to distance relationship.

It will be appreciated that, if it is deemed expedient to do so, either the speed relationship of the printing cylinder and the drive wheel, or the distance relationship of the drive wheel relative to the sheet conveyor may be controllable adjusted to maintain a controlled non-synchronized relationship between the printing cylinder and the sheet conveyor. For example, if it is desirable to advance the sheet a specified distance relative to the printing cylinder during each revolution of the printing cylinder, this condition can be established and maintained.

The preferred embodiment of the planetary system disclosed herein comprises a pair of endless epicyclical members, such as a conveyor drive wheel associated with a printing cylinder and a sheet conveyor, wherein the conveyor drive wheel comprises a circle which rolls around the inside or the outside of the circumference of the sheet conveyor. As will be hereinafter more fully explained, the sheet conveyor may be circular or, since it is an endless member, may be routed around a path other than a circle in a closed loop. In any event, the speed and distance relationship set forth above are maintained by either adjusting the relative speeds of the respective members or the relative lengths or circumferences thereof.

When the lengths or circumferences of the respective members are adjusted, it will be appreciated that at least one of the members will have a controllably variable geometry which is adjustable.

The planetary system is disclosed herein in combination with a sheet conveyor similar to that disclosed in the above listed United States Patents. When incorporated into this system, a positive, infinitely variable speed drive member is mounted in the drive system for the drive wheel of the conveyor to permit adjustment of the speed of rotation of the drive wheel to correct for any change in the circumference of the drive wheel as a result of thermal expansion or contraction. If the angular velocity of the drive wheel remained unchanged while the diameter of the drive wheel increased slightly as a result of thermal expansion, the surface speed of the conveyor driven by the drive wheel would increase thereby resulting in an inaccuracy of the sheet arriving at the printing cylinder which would result in the sheet not being registered with the printing cylinder. However, if the angular velocity of the drive wheel is adjusted to accommodate a change in the diameter of the drive wheel, the arrival time of the sheet to the printing cylinder can be precisely maintained. In the alternative, the angular velocity of the drive wheel may be left unchanged relative to the angular velocity of the printing cylinder if the length of the conveyor is adjusted to adjust the distance a gripper bar carrying a sheet travels during one complete revolution of the conveyor.

A primary object of the invention is to provide a planetary system wherein epicyclic members are maintained in a registered relationship even though the circumference of one of the members varies under normal operating conditions by adjusting the ratio of the speed to the geometric dimensions of the members.

Another object of the invention is to provide a conveyor for a sheet-fed printing press wherein the length of the conveyor is capable of adjustment for purposes of registering the conveyor with printing cylinders to provide a sheet-fed printing press in which the sheet is continuously gripped by a single set of grippers from the time the sheet enters the press at the feeder until it reaches the delivery station even though the dimensions of the conveyor drive wheels are variable.

A further object of the invention is to provide a conveyor, the length of the conveyor being adjustable for maintaining registry between the conveyor and another member, the conveyor moving at a constant speed along a path which is adjustable in length.

A still further object of the invention is to provide a conveyor having a fixed length which is driven by a drive wheel having a variable diameter driven by a variable speed drive means for maintaining registry between the conveyor and another member.

Other and further objects of the invention will become apparent upon referring to the detailed description hereinafter following and to the drawings annexed hereto.

DESCRIPTION OF THE DRAWINGS

The accompanying drawings illustrate a preferred embodiment of the invention and are provided so that the invention may be better and more fully understood, in which.

Numeral references are employed to designate like parts throughout the various figures of the drawing.

DESCRIPTION OF A PREFERRED EMBODIMENT

Figure 2:
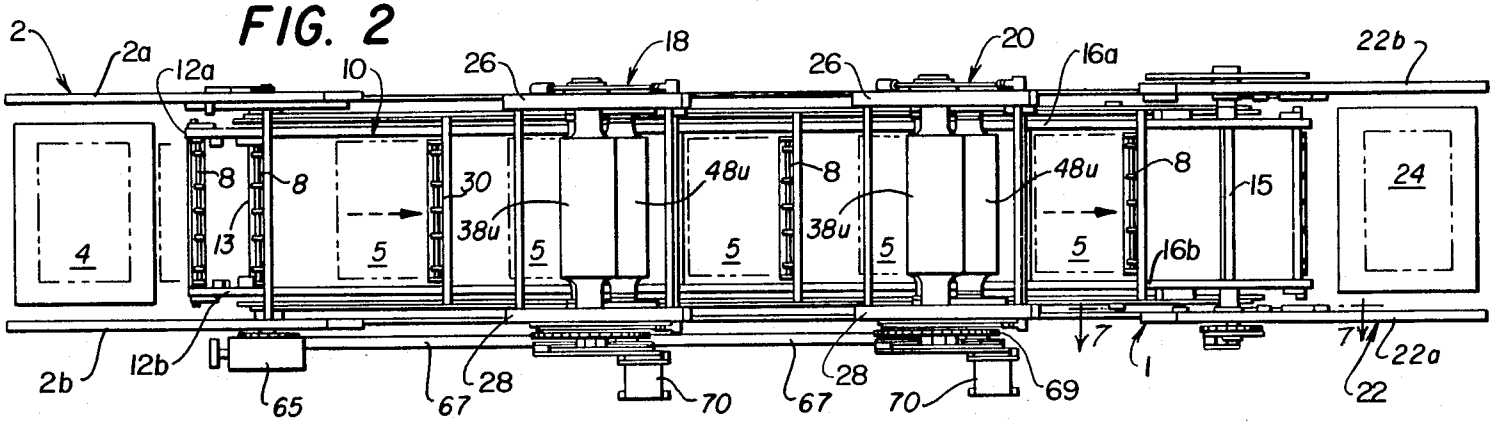
FIG. 2 is a top plan view of the printing press having inkers and dampeners removed therefrom.
Figure 1:
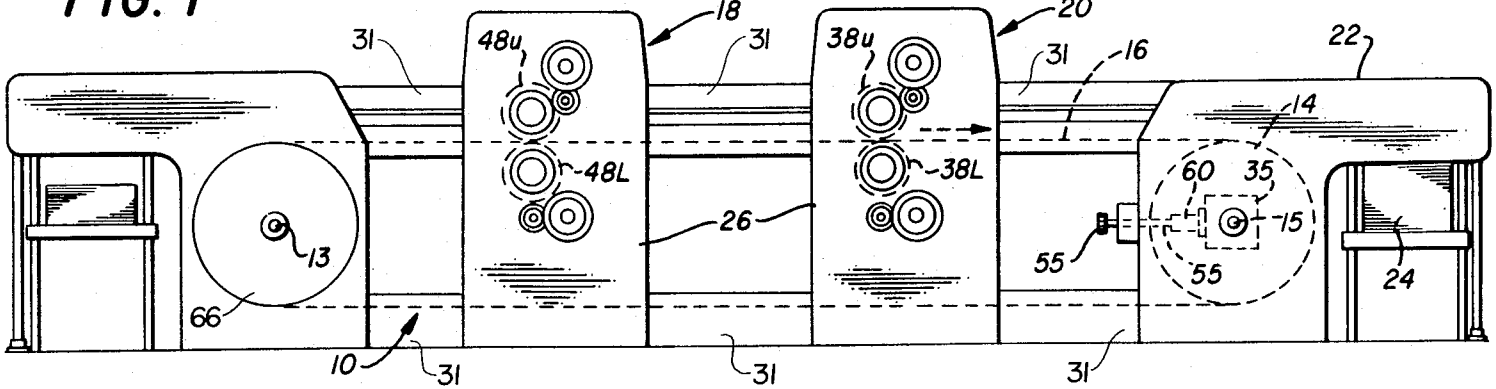
FIG. 1 is a side elevational view of the printing press.
Figure 3:
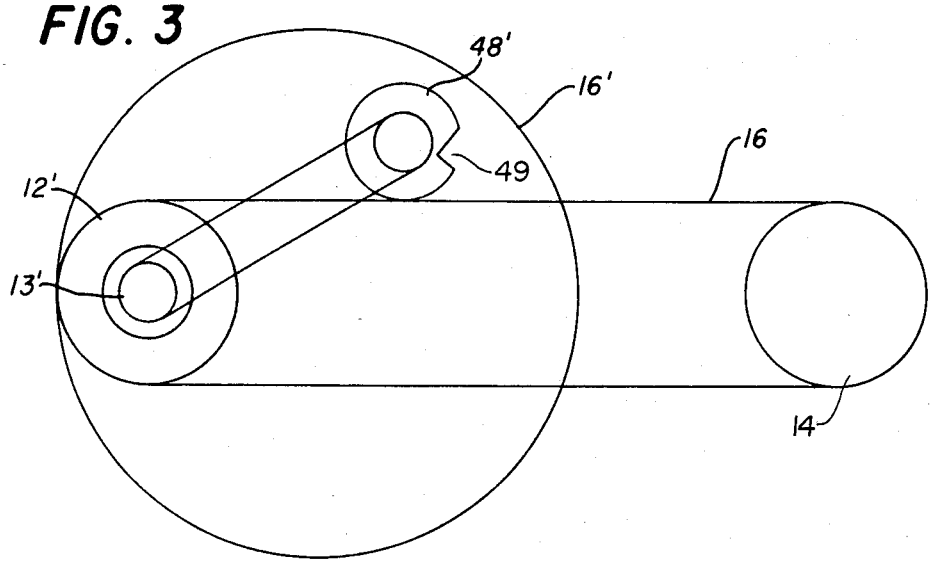
FIG. 3 is a diagrammatic view illustrating the relationship of the sheet conveyor to a conveyor drive wheel associated with a printing cylinder with planetary synchronization.

Referring to FIGS. 1, 2 and 3 of the drawing, the numeral 1 generally disignates a sheet-fed, multicolor, perfecting, lithographic printing press of the type disclosed in U.S. Pat. No. 3,847,079.

A feeder mechanism 2 delivers sheets of unprinted paper from a stack 4 to a swing gripper (not shown). The swing gripper accelerates individual sheets 5 to the velocity of gripper bars 8 carried by a sheet transfer mechanism 10. The sheet transfer mechanism 10 comprises drive wheels **12*a* and 12*b* adjacent the feeder end of the press and idler wheels 14*a* and 14*b* adjacent the delivery end of the printing press. The wheels carry tapes or bands 16*a* and 16*b*, having gripper bars 8 mounted therebetween for moving individual sheets 5** through the printing press.

In the illustrated embodiment, a pair of printing towers 18 and 20 are provided to give the press a multicolor, perfecting printing capability. It should be appreciated that any number of printing towers may be employed for printing additional colors or for coating sheets.

Individual sheets 5 are gripped by a delivery mechanism 22 as they are released by gripper bars 8 to form a stack 24 of printed sheets.

As best illustrated in FIG. 2, each printing tower 18 and 20 has a side frame 26 on the operator side of the press and a side frame 28 on the drive side of the press, joined by tie bars 30, to form a strong rigid frame structure upon which various components of the press are mounted. Feeder 2 and delivery 22 have side frames **2*a* and 22*a* on the operator side of the press and side frames 2*b* and 22*b* on the drive side of the press, respectively. Tie plates 31 join the side frames of feeder 2, printing tower 18, printing tower 20 and delivery 22** adjacent opposite sides of the printing press.

Each printing tower 18 and 20 is provided with an upper plate cylinder 38U and a lower plate cylinder 38L, an upper blanket cylinder 48U and a lower blanket cylinder 48L. It will be readily apparent that the upper and lower blanket cylinders 48U and 48L serve the dual function of a printing cylinder and a backup cylinder and engage opposite sides of sheets 5, as best illustrated in FIG. 1, carried through the printing press by gripper bars 8 extending between bands **16*a* and 16*b***.

Each blanket cylinder 48U and 48L has a gap 49 formed therein to permit movement of gripper bars 8 therebetween.

It will be appreciated that each plate cylinder 38U and 38L is equipped with plate clamps to facilitate securing a printing plate thereto and that each blanket cylinder 48U and 48L is equipped with clamps for securing a blanket thereto.

In the illustrated embodiment, inking systems and dampening systems for applying ink and dampening fluid to printing plates are not illustrated. In addition, circumferential and lateral register adjustments for the various cylinders are not illustrated. However, the provision of other and further conventional components is deemed to be within the skill of a press manufacturer.

Further, although the conveyor system is illustrated in combination with a lithographic printing press, the conveyor may be employed in any rotary printng system, for example, in which an image is applied by a printing plate to a blanket cylinder and offset onto a sheet, or, printed directly from a planographic printing plate, letter press, relief or intaglio printing plate or printing cylinder to a sheet. Further, the conveyor system may be employed with a mechanism for performing operations other than printing, for example, cutting, folding, slitting, punching, reading indicia and the like.

SHEET TRANSFER MECHANISM

The sheet transfer mechanism 10, hereinbefore briefly described, includes drive wheels 12*a* and 12*b* connected to an axle 13 adjacent the feeder 2 of the printing press and idler wheels 14*a* and 14*b* rotatably secured about an axle 15 adjacent sheet delivery mechanism 22. Band 16*a*, adjacent the operator side of the printing press, extends around wheels 12*a* and 14*a*, while band 16*b*, adjacent the drive side of the press, extends about wheels 12*b* and 14*b*. As will be hereinafter more fully explained, axle 13 is driven and traction between the surfaces of wheels 12*a* and 12*b* and bands 16*a* and 16*b*, respectively, imparts motion to the bands.

The conveyor system 10 is a mechanical device that carries the sheet 5 through the printing press 1. For proper printing to occur, the conveyor system 10 must offer mechanical repeatability of the sheet relative to each printing tower 18 and 20.

The bands 16*a* and 16*b* have been formed with good results from a strip of steel material 3.500 inches wide and 0.042 inch thick to provide a cross-sectional area of 0.147 square inches for each band. The band material is preferably a 1095 carbon steel, heat treated to a hardness of Rockwell C 47 and has a modulus of elasticity of $30\times10^6$ pounds per square inch.

Opposite ends of each of the strips of material are joined together by a riveted aircraft-type splice joint consisting of two plates, one being 0.020 inch thick and the other being 0.035 inch thick secured by flat-head hi-shear rivets extended through countersunk holes in the band to opposite sides of the band. The thinner plate will deflect before the thicker plate for distributing the load and the tension in the band to the rivets in a uniform manner to enhance the fatigue life of the joint.

Outer peripheries of wheels 12*a*, 12*b*, 14*a* and 14*b* are of substantially identical construction, each having a flange 11 secured to opposite sides thereof to form a groove into which tapes 16 extend. Flanges 11 merely prevent lateral movement of tapes 16 relative to wheels 12 and 14.

Figure 8:
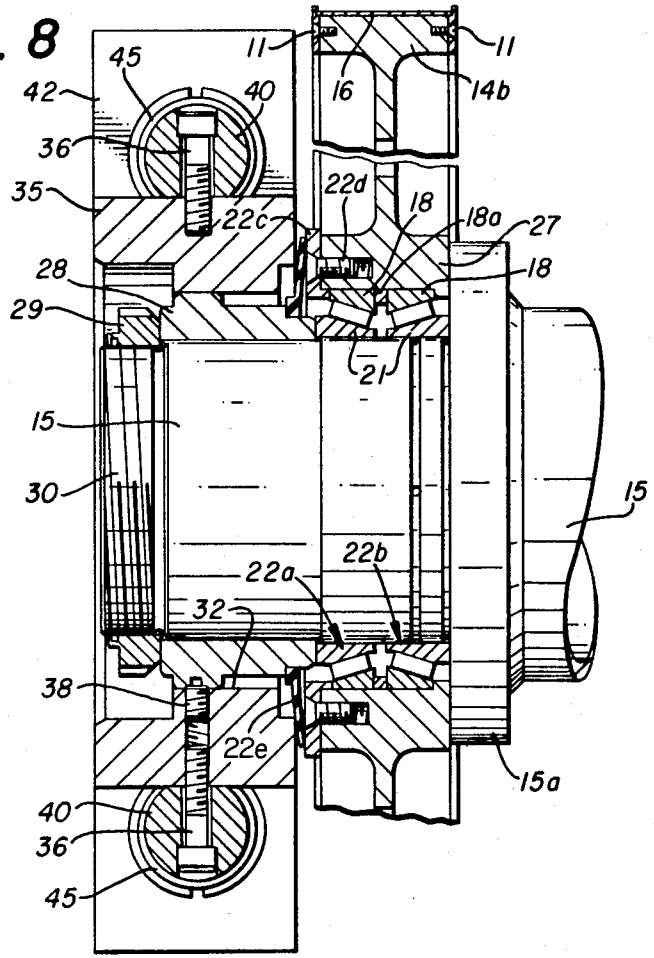
FIG. 8 is cross-sectional view taken along line 8—8 of FIG. 7.

As best illustrated in FIG. 8, idler wheels 14 at the delivery end of the printing press are freely rotatable about the non-rotatable axle 15 and have an inner hub 27 having a passage formed therethrough to receive the outer races 18 of bearings 22*a* and 22*b*. The inner races 21 of each of the bearings 22*a* and 22*b* are secured to axle 15. Each end of axle 15 has a hub 15*a* for restraining bearings 22*a* and 22*b* against inward movement on axle 15.

A retainer sleeve 28 extends around the outer end of axle 15 and engages the inner race 21 of the outer bearing 22*a*. Sleeve 28 is captured by a lock nut 29 threadedly secured to the outer end of a journal 30 on the outer extremity of axle 15.

Sleeve 28 extends through and is secured in an opening 32 formed in bearing block 35 which is secured by bolts 36 to support pins 40.

To assure that sleeve 28 and bearing block 35 are laterally secured together and located in a precise relationship relative to each other, a single set screw 38 is provided on one side of the press only.

Brackets 42 and 44 have spaced aligned apertures formed therein in which bearings 45 are secured. Opposite ends of support pins 40 are slidably secured in bearings 45 to permit movement of bearing block 35 and shaft 15. Brackets 42 and 44 are secured by bolts 46 to side frames 22*a* and 22*b* of delivery station 22.

As illustrated in FIG. 8, a bearing retainer disc 22*c* is secured by screws 22*d* to tape wheel 14*b* for restraining the outer race 18 of bearing 22*a* against outer movement. A grease seal 22*e* is urged into sealing relation with bearing disc 22*c* and sleeve 28 to retain lubricating oil adjacent to bearings 22*a* and 22*b*. The inner races 21 of bearings 22*a* and 22*b* are pre-loaded relative to out races 18 by adjusting nut 29 and the outer races are separated by spacer 18*a*.

Figure 9:
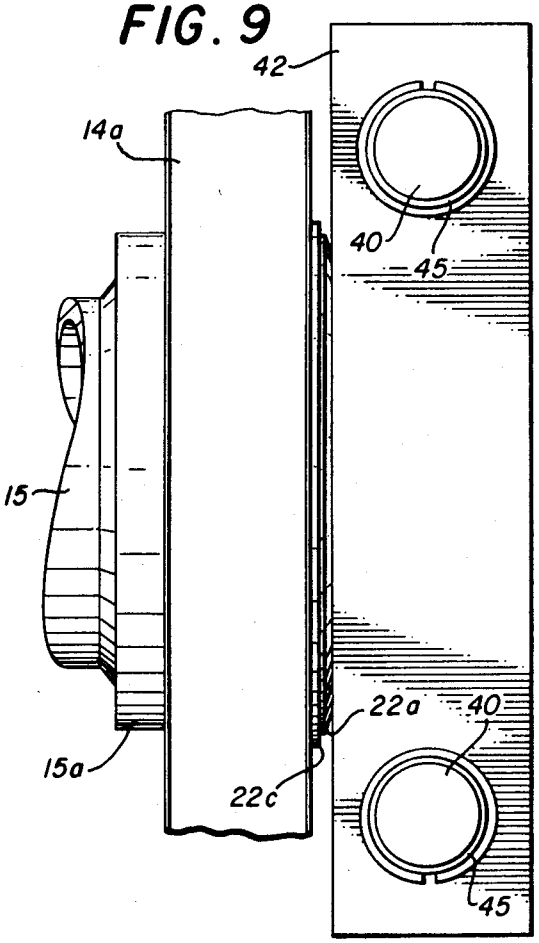
FIG. 9 is an elevational view looking in the direction of arrows 9—9 in FIG. 7.

Idler wheel 14*a* is similarly mounted on the opposite end of axle 15, as illustrated in FIG. 9. Each idler wheel is therefore independently adjustable and not rigidly secured to axle 15 such that each idler wheel is rotatable relative to the other.

Figure 7:
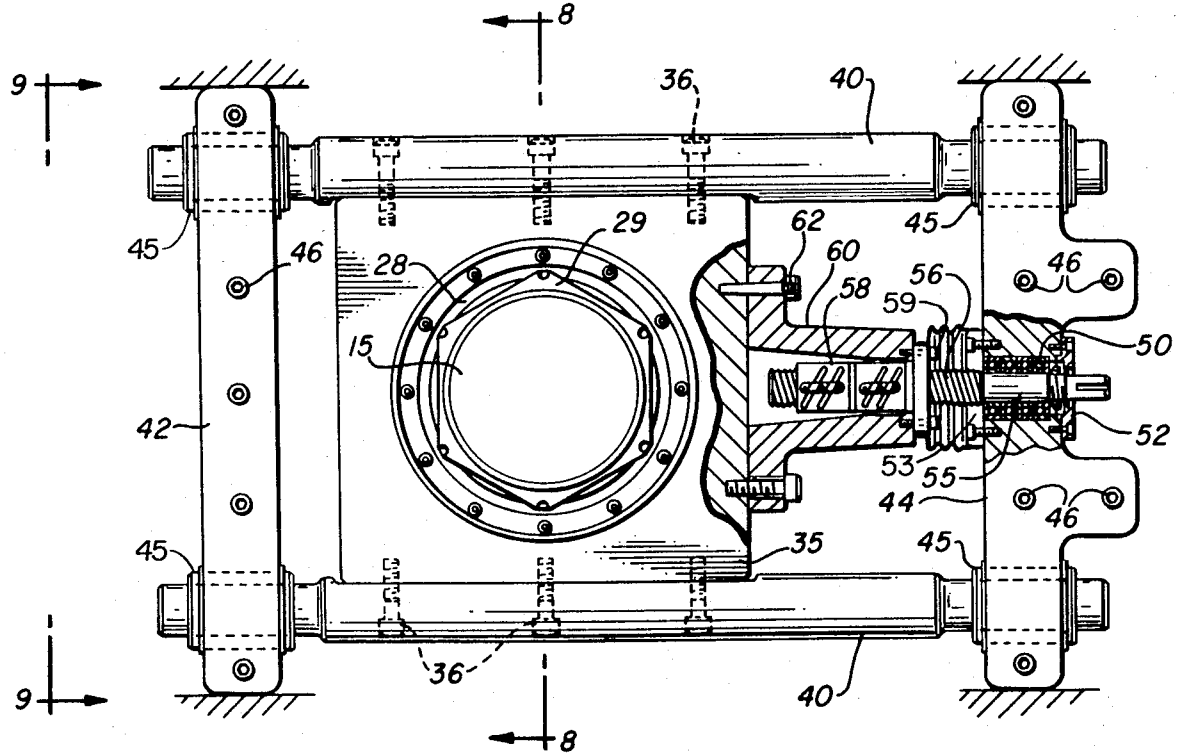
FIG. 7 is an enlarged cross-sectional view taken along line 7—7 of FIG. 2.

Referring to FIG. 7 of the drawing, it will be noted that bracket 44 has an aperture formed in a central portion thereof in which a bearing 50 is secured between lock plates 52 and 53 to prevent longitudinal movement of drive screw 55 relative to bracket 44. Drive screw 55 is of conventional design and has a ball screw portion 56 formed on the inner end thereof.

A ball nut 58 is secured by screws 59 to member 60 which is in turn secured by screws 62 to bearing block 35.

The ball screw 56 and ball nut 58 are of conventional design and are available from Saginaw Steering Gear Division of General Motors Corporation, Actuator Products Group, Saginaw, Mich. The ball bearing screw is a force and motion transfer device belonging to the family of power transmission screws. It replaces the sliding friction of the conventional power screw with the rolling friction of ball bearings. The ball bearings circulate in hardened steel races formed by concave helical grooves in the screw and nut. All reactive loads between screw and nut are carried by the bearing balls which provide the only physical contact between the members. As the screw and nut rotate relative to each other, the bearing balls are diverted from one end and carried by ball guide return tubes to the opposite end of the ball nut. This recirculation permits unrestricted travel of the nut in relation to the screw. Drive screw 55 has a 0.200 inch per revolution lead.

From the foregoing it should be readily apparent that rotation of drive screw 55 imparts longitudinal movement through ball nut 58 to bearing block 35 thereby moving axle 15 in a horizontal direction relative to axle 13 at the opposite end of the printing press. The change in length of bands 16*a* and 16*b* is two times the change in the distance between the axes of axles 13 and 15. Thus, one complete revolution of screw 55, having a lead of 0.200 inches, would result in a change of the length of band 16 of 0.400 inches.

Drive wheels 12*a* and 12*b* adjacent the feeder end of the printing press are rigidly secured to axle 13 which is rotatably secured to feeder side frames 2*a* and 2*b*. A gear 66 secured to the end of axle 13, is driven through a positive, infinitely variable speed control device 65 by line shaft 67 which drives gear trains 68 and 69 connected to plate cylinders and blanket cylinders in printing towers 18 and 20. Line shaft 67 is driven by one or more motors 70 connected through suitable gear trains, V-belts and sleeves, and gear boxes for transmitting the speed and driving force required for driving the printing towers and the conveyor system.

It will be readily apparent that the speed ratio between printing cylinders 48U and 48L and drive wheels 12*a* and 12*b* can be changed by adjusting speed control device 65 which will result in changing the ratio of the angular velocity of the input from shaft 67 to control device 65 relative to the angular velocity of the output of control device 65 to axle 13.

It will be readily apparent that each of the idler wheels 14*a* and 14*b* is equipped with a separate screw 55 to permit adjustment of the distance between the axes of wheels 12*a* and 14*a* independently of the adjustment of the distance between the axes of wheels 12*b* and 14*b*. Thus, the length of bands 16*a* and 16*b* are independently adjustable.

Figure 4:
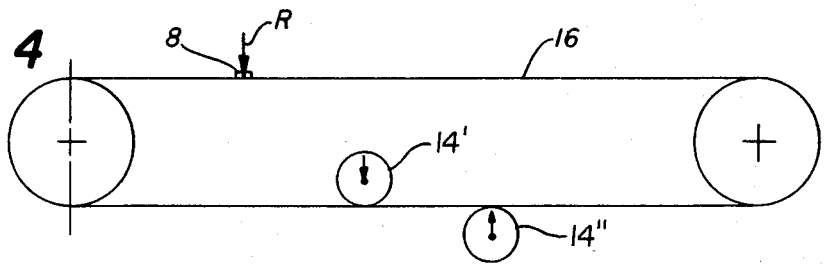
FIG. 4 is a diagrammatic view of a sheet conveyor which is properly registered.
Figure 5:
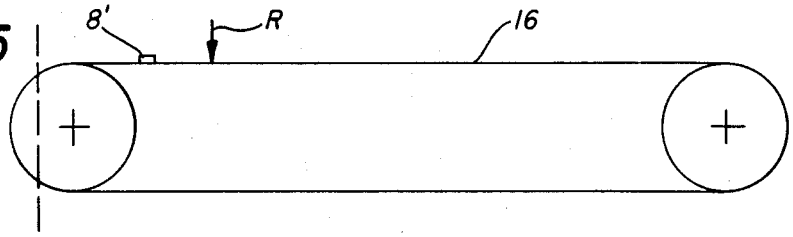
FIG. 5 is a diagrammatic view similar to FIG. 4 in which the path of the sheet conveyor is too short.
Figure 6:
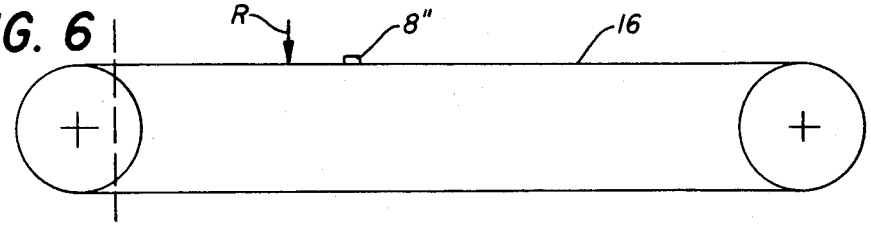
FIG. 6 is a diagrammatic view similar to FIG. 4 in which the length of the sheet conveyor is too long.

It should be appreciated that the length of bands 16*a* and 16*b* may be adjusted by moving third and/or fourth wheels 14', 14'' positioned either above or below one of the flights of bands 16*a* or 16*b*, as shown in dashed outline in FIG. 4.

Initial band tension has been chosen to be 1,800 pounds in each band. This tension is achieved by manufacturing the individual bands to a length shorter than the desired installed length. Each band is elongated during installation to the desired length. As hereinbefore described, the distance between the axes of wheels 12*a* and 14*a* is adjustable to deflect the band to the final length.

A conveyor system which has been constructed for testing employed wheels 12*a*, 12*b*, 14*a*, and 14*b* having a diameter of 47.958 inches plus the thickness of the band which was 0.042 inch and thus provided a nominal pitch line diameter of 48.000 inches. The length of band driven by each drive wheel 12*a* and a 12*b* during one revolution is 48.000 inches times $\pi$. This figure is approximately 150.7963 inches. The design ratio of the diameter of the conveyor drive wheels 12*a* and 12*b* to the diameter of the sixteen inch printing cylinders 38U and 38L was 3:1 while the ratio of the drive wheel to a 24 gripper bar system is 8:1. Multiplying 150.7963 by 8 gives 1206.3705 inches for the nominal final length of the band. The manufactured length of the band to achieve a 1,800 pound pre-load on the band, was 25.1227 times 48 which equals 1205.8883 or a total of 0.4922 inches shorter than the installed length of the band. Using the equation in which $\Delta = PLE/AE$, where $\Delta$ equals 0.4922, $L = 1206.3705$ inches, $A = 0.042 \times 3.5$ square inches and $E = 30 \times 106$ pounds per square inch; a load of P is equal to 1800 pounds.

Since the final length of the band is designed to be a function of the diameter of the driven wheel 12*a* and 12*b*, it can be seen that no two wheels can be made and maintained precisely identical diameter or that the length of the band driven thereby of precisely identical length established by the distance between drive and idler wheels, for moving gripper bars 8 through the printing press. Further, the idler wheels 14*a* and 14*b* cannot be made exactly the same diameter as drive wheels 12*a* and 12*b*. Therefore, no two pairs or two systems of bands and wheels can perform identically in practice. Therefore, idler wheels 14*a* and 14*b* are mounted to rotate independently of each other at the delivery end of the press.

Fixed band lengths can therefore work only on fixed dimensions of wheels and center distances therebetween which cannot be manufactured and/or maintained.

Axle 13 at the feeder end of the press is driven, as hereinbefore described and axle 13 is secured in an established position. This is desirable because swing grippers (not shown) must register with the conveyor 10 for feeding sheets to the sheet conveyor. Thus, by maintaining driven axle 13 in a fixed positon, register can be established and maintained between feeder 2 and conveyor 10. Further, since opposite ends of axle 15 can be moved independently by screws 55, axle 15 will not necessarily be maintained in a precisely aligned parallel relationship to driven axle 13.

Drive wheels 12*a* and 12*b* are rigidly secured to drive axle 13 to maintain the timing of band 16*a* relative to band 16*b*. However, the timing of the idler wheels 14*a* and 14*b* relative to each other is a variable that is unpredictable. Therefore, in the illustrated embodiment, the two idler wheels 14*a* and 14*b* are allowed to rotate freely and independently of each other since their speed of revolution will vary according to the actual diameter of the respective wheels.

As hereinbefore described, the main function of the conveyor system is to afford repeatability of the sheet relative to each printing tower 18 and 20. Mechanical repeat of conveyor bands 16*a* and 16*b* relative to drive wheels 12*a* and 12*b* occurs every eight revolutions of the drive wheels. Therefore, the length of the band is eight times the theoretical circumference of drive wheels 12*a* and 12*b*.

Assuming that the length of the band 16*a* or 16*b* is not equal to exactly eight times the circumference of drive wheels 12*a* and 12*b* then the mechanical repeat every eight revolutions of drive wheels 12*a* and 12*b* would not exist. With each cycle of bands 16*a* and 16*b*, an error will be noticed in the repeat of drive wheels 12*a* and 12*b* relative to the bands 16*a* and 16*b*. If this error is monitored, it will be seen that the error will accumulate with each cycle as a function of the error in the center distance between axes of axles 13 and 15 or the error in the length of the band. The actual function of repeatability to center distance error is: error equal two times center distance error. For example, if the center distance is 0.001 inches more or less than it should be, after one complete revolution, the error repeat of the band and the drive wheel will be 0.002 inches. An initial position error could also exist with the band mounting on the wheel. In other words, the band could be initially misplaced relative to the wheel 12*a* or 12*b* even though the distance between axes of axles 13 and 15 is proper. In this instance, the error should not accumulate with each revolution of the drive wheel but would remain constant.

The initial 1,800 pound tension in bands 16*a* and 16*b* is established and maintained for two reasons. First, to insure the tractive capability of the band and wheel arrangement such that no slippage will occur between drive wheels 12*a* and 12*b* and bands 16*a* and 16*b*. The tractive force is a function of the co-efficient of friction times the force normal to the surface of the drive wheels 12*a* and 12*b*. Second, tension in bands 16*a* and 16*b* is required to prevent a loss of tension or frictional driving force during normal thermal build-up of the conveyor system under normal operating conditions. Assuming, for instance, that the conveyor bands 16*a* and 16*b* were manufactured at an ambient temperature of 72° F., at a length of 1205.8883 inches and assuming that the band expands $6\times10^{-6}$ inches per inch of length per degree Fahrenheit; then one could assume that manufactured length of 1205.8883 inches, upon a temperature rise of 20° from 72° F. to 92° F. would result in an expansion of the length of the conveyor band 16*a* or 16*b* by 0.1447 inches. A reduction in tension would result equal to the difference between 1,800 pounds at 0.4922 inches deflection and 1273.185 pounds at 0.3482 inches deflection. Although the length of the band 16*a* or 16*b* would not change because tension is still being maintained in the band, the tension would drop to 1,273.185 pounds as a result of the increase in ambient temperature. It should be noted that the band would not change in length until the tension actually dropped to zero pounds, then it would begin to expand in length.

Referring to FIG. 3 of the drawing, it should be appreciated that conveyor bands 16 and 16' are flexible and are routed around drive wheels 12 and idler wheels 14 to form a closed loop. In FIG. 3, bands 16 have been illustrated in dashed outline as a ring or circular loop 16' having a smooth surface in rolling relation with the smooth surface of drive wheel 12'. Drive wheel 12' rotates about axis 13' to impart rotation to band 16'.

Assuming that slippage does not occur between the surfaces of drive wheel 12' and band 16' the circumference of circle 16' must be an exact multiple of the circumference of circle 12' for the respective circles to return to the precise position illustrated after one revolution of circle 16'.

However, it will be appreciated that if the diameter of circle 12' changes for some reason while the diameter of circle 16' remains unchanged, the two circles will not return to the precise position upon one complete revolution of circle 16' For example, if circle 12' is 48 inches in diameter and constructed of material having a co-efficient of thermal expansion of $6\times10^{-6}$ inches per inch of length per degree Fahrenheit, the circumference of circle 12' would change 0.0009 inches for one degree temperature change.

Assuming that the temperature increased one degree Fahrenheit, the diameter of circle 12' would increase from 48 inches to 48.0009 inches. If the angular velocity of drive wheel 12' remained precisely the same as the angular velocity of printing cylinder 48', it will be appreciated that bands 16' will not be properly synchronized with printing cylinder 48'.

However, if the angular velocity of cylinder 12' is changed relative to the angular velocity of printing cylinder 48' by adjusting the positive, infinitely variable, speed control device 65, as herebefore described, band 16' and printing cylinder 48' can be moved in synchronized relationship even though the diameter of drive wheel 12' has been changed.

Assuming that the angular velocity of printing cylinder 48' and drive wheel 12' remain unchanged, band 16' can be moved in synchronized relation with printing cylinder 48' by changing the circumference of the band 16' to accommodate the change in the circumference of drive wheel 12'.

The error in the registration of this sheet carried by the gripper bars 8 relative to printing cylinder 48U and 48L can be monitored in a variety of ways including visually inspecting the sheets at the delivery end of the printing press. If the drive wheel 12 has changed in diameter as the result of thermal expansion which has resulted in the conveyor bands 16 moving at the improper speed relative to printing cylinders 48U and 48L, the error will accumulate and increase with each revolution of the printing press. When the error becomes apparent from an inspection of the printed sheets, the pressman may either adjust the surface speed of drive wheels 12A and 12B by adjusting the speed control device 65 to cause conveyor belts to be driven at the proper surface speed, or drive screw 55 may be rotated for adjusting the length of bands 16 relative to the circumference of drive wheel 12 to register sheets carried by the conveyor relative to the printing cylinder.

What is claimed is:

1. In a device for moving a sheet of paper relative to a printing cylinder in a printing press comprising a printing cylinder; an impression cylinder; a pair of drive wheels, one of the said drive wheels being positioned adjacent each side of said printing press; variable speed drive means to rotate said drive wheels and to synchronize the speed of the drive wheels with the speed of the printing and impression cylinders; a second pair of wheels adjacent the opposite end of the printing press; a pair of endless steel tapes, one of said tapes extending about one of said second pair of wheels and a drive wheel adjacent one side of the press and the other of said tapes extending about a drive wheel and another of said second pair of wheels adjacent the opposite side of the printing press; gripper bars secured to and extending between said tapes, spacing between the second wheel and drive wheel adjacent each side of the press being adjustable for adjusting tension in the tapes, the improvement comprising: said second pair of wheels being idler wheels; means supporting said idler wheels such that the idler wheels are driven by the tapes and each idler wheel is rotatable independently of the other idler wheel and independently of the drive wheels; positive adjusting means for adjusting the position of the idler wheels such that a change in temperature of said tapes will result in a change in tension in said tapes but not a change in the length of said tapes, said adjustment means being adapted for independent adjustment of the length of each of said tapes for changing the length of the distance between gripper bars on each of said tapes.

2. The combination of claim 1 wherein said printing cylinder, impression cylinder and drive wheels are driven by a single variable speed drive at a fixed speed relationship.

3. The combination of claim 1, said printing cylinder and impression cylinder being driven by a first variable speed drive means; and second variable speed drive means drivingly connected to said drive wheels to permit adjustment of the speed of the drive wheels relative to the speed of the printing cylinder.

* * * * *

UNITED STATES PATENT AND TRADEMARK OFFICE

CERTIFICATE OF CORRECTION

PATENT NO. : 4,515,079

DATED : May 7, 1985

INVENTOR(S) : Harold P. Dahlgren

It is certified that error appears in the above-identified patent and that said Letters Patent is hereby corrected as shown below:

Column 8, line 1, change "$\Delta$ = PLE/AE" to

-- $\Delta$ = PL/AE --

Column 8, line 3, change "106" to -- $10^6$ --

Signed and Sealed this

*Twenty-seventh* Day of *August 1985*

[SEAL]

*Attest:*

DONALD J. QUIGG

*Attesting Officer* *Acting Commissioner of Patents and Trademarks*